US009998831B1

(12) United States Patent
Tang

(10) Patent No.: US 9,998,831 B1
(45) Date of Patent: Jun. 12, 2018

(54) SPEAKER

(71) Applicant: Yun Tang, Shenzhen (CN)

(72) Inventor: Yun Tang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/416,252

(22) Filed: Jan. 26, 2017

(30) Foreign Application Priority Data

Dec. 10, 2016 (CN) ..... 2016 2 1355751 U

(51) Int. Cl.

| | |
|---|---|
| ***H04R 1/02*** | (2006.01) |
| ***H04R 9/04*** | (2006.01) |
| ***H04R 9/06*** | (2006.01) |
| *H04R 7/00* | (2006.01) |
| *H04R 7/04* | (2006.01) |
| *H04R 7/16* | (2006.01) |

(52) U.S. Cl.
CPC ..... *H04R 9/043* (2013.01); *H04R 9/06* (2013.01); *H04R 7/04* (2013.01); *H04R 7/16* (2013.01); *H04R 2400/11* (2013.01)

(58) Field of Classification Search
CPC ..... H04R 9/043; H04R 9/045; H04R 9/025; H04R 2499/11; H04R 2209/22
USPC ..... 381/396, 405, 398, 406
See application file for complete search history.

(56) References Cited

U.S. PATENT DOCUMENTS

2007/0217645 A1* 9/2007 Ishihara ..... H04R 7/04 381/396

* cited by examiner

*Primary Examiner* — Sunita Joshi
(74) *Attorney, Agent, or Firm* — Na Xu; IPro, PLLC

(57) ABSTRACT

A speaker is provided in the present disclosure. The speaker includes a frame with a receiving space, a vibration system and a magnetic circuit system which are received in the frame, wherein the vibration system comprises a diaphragm fixedly connected to the frame, a voice coil for driving the diaphragm to vibrate and a voice coil lead connected with the voice coil; the diaphragm comprises a dome portion in the center, and a suspension portion extended from the dome portion and encircling the dome portion; the dome portion comprises a main body portion connected with the voice coil and an extended portion extended from the main body portion to the outgoing line direction of the voice coil lead; and the central axis of the diaphragm and the central axis of the magnetic circuit system are non-coaxial and parallel.

5 Claims, 2 Drawing Sheets

SPEAKER

FIELD OF THE DISCLOSURE

The present disclosure relates to the technical field of electro-acoustic conversion and more particularly, to a speaker.

BACKGROUND

In relevant arts, the speaker includes a frame, as well as a vibration system and a magnetic circuit system which are received in the frame, wherein the vibration system includes a diaphragm, a voice coil for driving the diaphragm to vibrate, and a voice coil lead for connecting the voice coil with an external circuit. The diaphragm and the magnetic circuit system share one central axis, so that the vibration system and the magnetic circuit system are symmetrical. However, the outgoing line of the voice coil lead is always not symmetrical, so that an asymmetrical torque is produced, the speaker swings, and the tone quality of the whole speaker is influenced.

Therefore, it is desired to provide a speaker to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
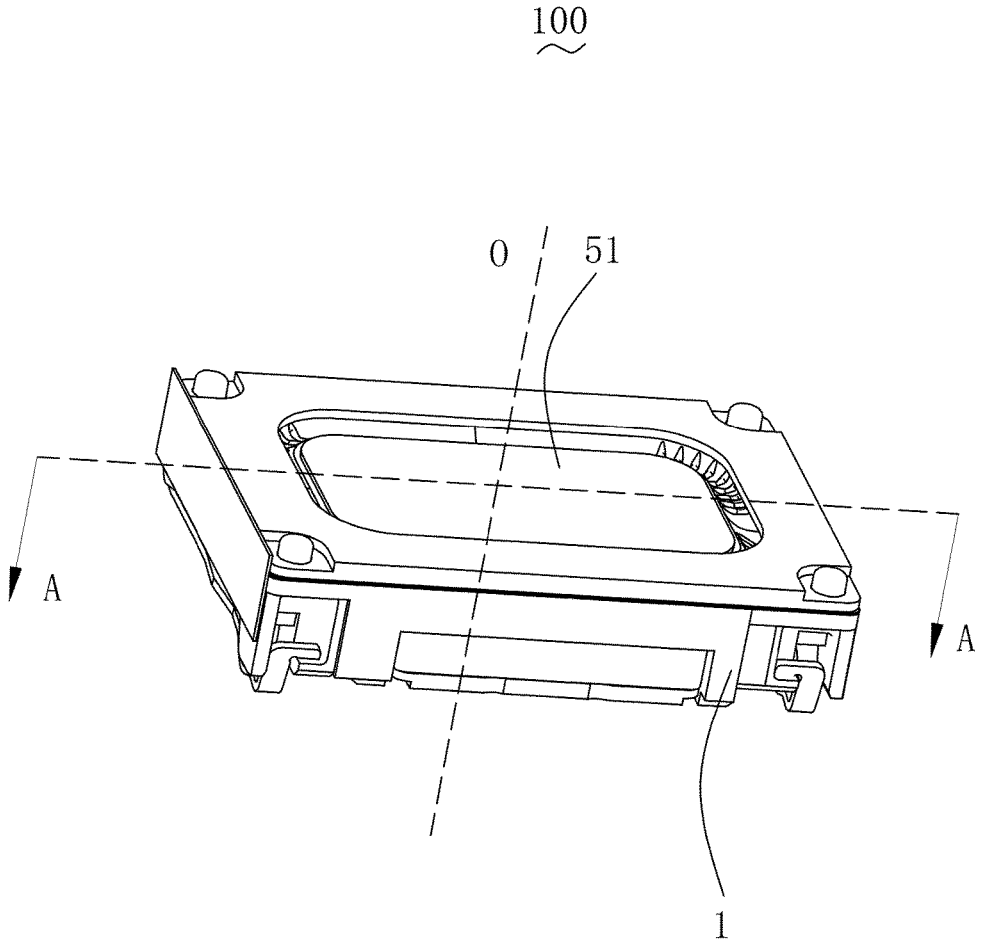
FIG. 1 is a schematic diagram of a three-dimensional structure of a speaker provided by the present disclosure.
Figure 2:
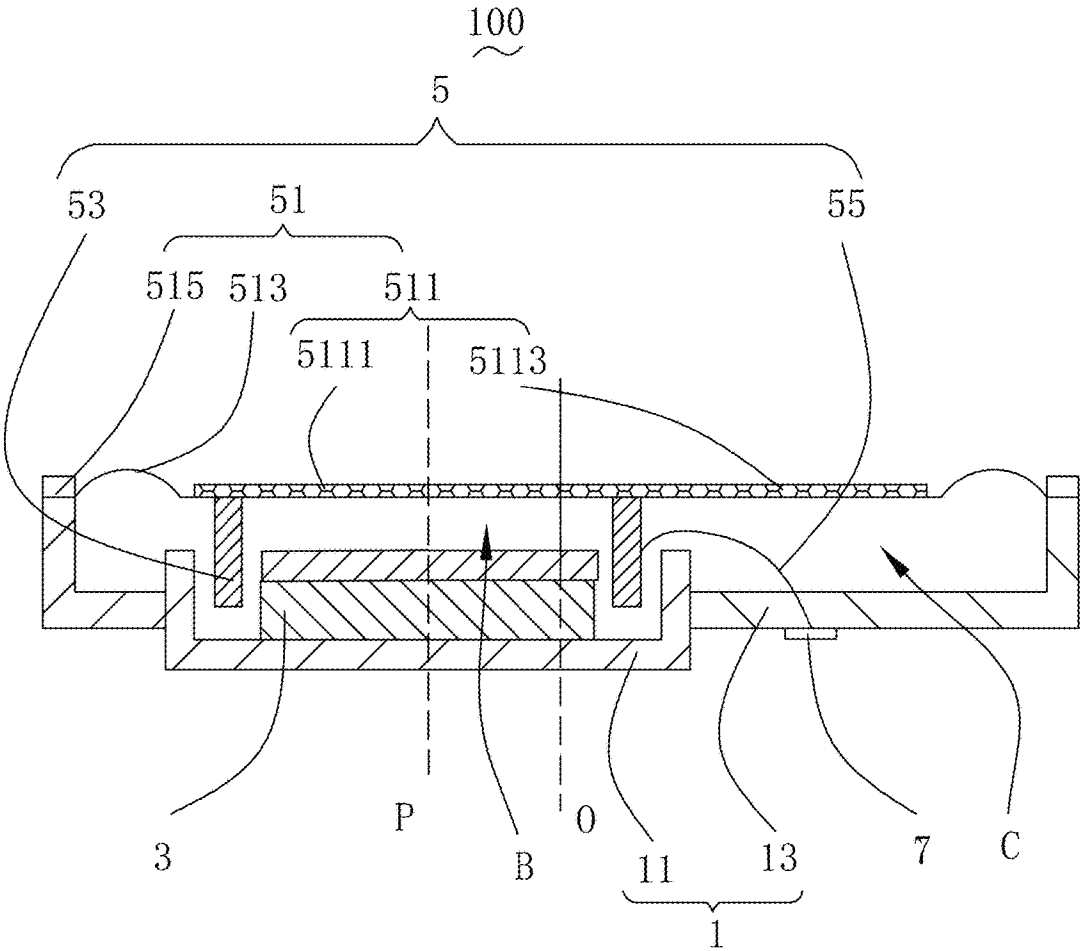
FIG. 2 is a cross-sectional schematic diagram of the speaker shown in FIG. 1 along an A-A line.

As shown in FIGS. 1 and 2, a speaker 100 includes a frame 1, a magnetic circuit system 3 and a vibration system 5 which are received in the frame 1, and a pad 7 disposed on the frame 1.

In this embodiment, the magnetic circuit system 3 includes a main magnet. In other embodiments, the magnetic circuit system 3 may also include a yoke received in the frame and a secondary magnet arranged on the yoke and surrounding the main magnet, and a magnetic gap is formed between the main magnet and the secondary magnet; in addition, the presence of only one of the secondary magnet and the yoke is feasible. In conclusion, actually as long as the magnetic circuit system 3 can form the magnetic gap, it is the content disclosed by the present disclosure.

The vibration system 5 includes a diaphragm 51 fixedly connected to the frame 1, a voice coil 53 for driving the diaphragm 51 to vibrate and a voice coil lead 55 connected with the voice coil. The central axis o of the diaphragm 51 and the central axis P of the magnetic circuit system 3 are non-coaxial and parallel. The diaphragm 51 includes a dome portion 511, a suspension portion 513 extended from the dome portion 511 and encircling the dome portion and a fixed portion 515 extended from the suspension portion 513, wherein the fixed portion 515 is of a ring-shaped structure and is connected with the frame 1. The voice coil 53 is inserted into the magnetic gap. The voice coil lead 55 is connected with the pad 7, and the voice coil 53 is electrically connected with an external circuit via the voice coil lead 55 and the pad 7.

The dome portion 511 includes a main body portion 5111 connected with the voice coil 53 and an extended portion 5113 extended from the main body portion 5111 to the outgoing line direction of the voice coil lead 55. Specifically, one end of the voice coil 53 is connected with the diaphragm 51, while the other end is inserted into the magnetic gap. The frame 1 includes a main frame 11 matched with the diaphragm 51 to form a receiving space B, and a secondary frame 13 extended from the main frame 11 to the outgoing line direction of the voice coil lead 55. The fixed portion 515 is connected with the main frame 11 and the secondary frame 13. The magnetic circuit system 3 and the voice coil 53 are received in the receiving space B, the secondary frame 13 is matched with the diaphragm 51 to form a rear cavity C, and the receiving space B is communicated with the rear cavity C.

Compared with the relevant arts, the speaker of the present disclosure has the advantages that the extended portion is disposed in the outgoing line direction of the voice coil lead, and the central axis of the diaphragm and the central axis of the magnetic circuit system are non-coaxial and parallel, so that the torque generated by the voice coil lead is compensated, and swinging of the speaker is reduced; meanwhile, a part of the diaphragm is supported by the extended portion and the frame to form the rear cavity, so that the step for additionally manufacturing a cavity to form the rear cavity is saved, therefore, the structure is simple and the quality of the speaker is improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a frame with a receiving space;

a vibration system and a magnetic circuit system which are received in the frame;

wherein the vibration system comprises a diaphragm fixedly connected to the frame, a voice coil for driving the diaphragm to vibrate and a voice coil lead connected with the voice coil; the diaphragm comprises a dome portion in the center, and a suspension portion extended from the dome portion and encircling the dome portion; the dome portion comprises a main body portion connected with the voice coil and an extended portion extended from the main body portion to the outgoing line direction of the voice coil lead; and the central axis of the diaphragm and the central axis of the magnetic circuit system are non-coaxial and parallel.

2. The speaker as described in claim 1, wherein the central axis of the magnetic circuit system and the voice coil lead are respectively located on two sides of the central axis of the diaphragm.

3. The speaker as described in claim 2, wherein the frame comprises a main frame matched with the diaphragm to form a receiving space and a secondary frame extended from the main frame to the outgoing line direction of the voice coil lead, the magnetic circuit system and the voice coil are received in the receiving space, the secondary frame is matched with the diaphragm to form a rear cavity, and the rear cavity is communicated with the receiving space.

4. The speaker as described in claim 3, wherein the diaphragm further comprises a fixed portion extended from the suspension portion, the fixed portion is of a ring-shaped structure, and the fixed portion is separately connected with the main frame and the secondary frame.

5. The speaker as described in claim 3, wherein the frame further comprises a pad disposed on the secondary frame, the voice coil lead is connected with the pad, and the voice coil is electrically connected with an external circuit via the voice coil lead and the pad.

* * * * *